United States Patent [19]

Hill et al.

[11] Patent Number: 4,947,788

[45] Date of Patent: Aug. 14, 1990

[54] DEVELOPMENT STATION HAVING TONER MONITOR

[75] Inventors: Lawrence A. Hill; Arthur S. Kroll; Ralph E. Williams, all of Rochester, N.Y.

[73] Assignee: Eastman Kodak Company, Rochester, N.Y.

[21] Appl. No.: 258,938

[22] Filed: Oct. 17, 1988

[51] Int. Cl.[5] ..... G03G 15/06

[52] U.S. Cl. ..... 118/653; 118/689; 355/208; 355/246

[58] Field of Search ..... 355/246, 260, 208; 118/689, 653, 656, 657, 658; 222/DIG. 1

[56] References Cited

U.S. PATENT DOCUMENTS

| | | | |
|---|---|---|---|
| 4,174,902 | 11/1979 | Hamaguchi | 222/DIG. 1 |
| 4,276,854 | 7/1981 | Fujita et al. | 355/246 X |
| 4,582,415 | 4/1986 | Hyodo et al. | 355/203 |
| 4,601,259 | 7/1986 | Yamashita | 355/260 X |
| 4,650,310 | 3/1987 | Hayashida et al. | 355/246 |
| 4,671,646 | 6/1987 | Florack et al. | 355/246 |

FOREIGN PATENT DOCUMENTS

| | | | |
|---|---|---|---|
| 0129766 | 7/1985 | Japan | 355/246 |

*Primary Examiner*—A. T. Grimley
*Assistant Examiner*—Robert Beatty
*Attorney, Agent, or Firm*—Milton S. Sales

[57] ABSTRACT

A replaceable development station usable for developing electrostatic images in an apparatus having a toner monitor and a channel for slidably receiving the development station includes a chamber containing a supply of a development mixture of toner and carrier particles. A recess is defined in one wall of the chamber for receiving the toner monitor, the recess being defined by a thinned region of the wall such that the toner monitor is separated from the developer mixture by a wall region substantially thinner than the general wall thickness.

4 Claims, 5 Drawing Sheets

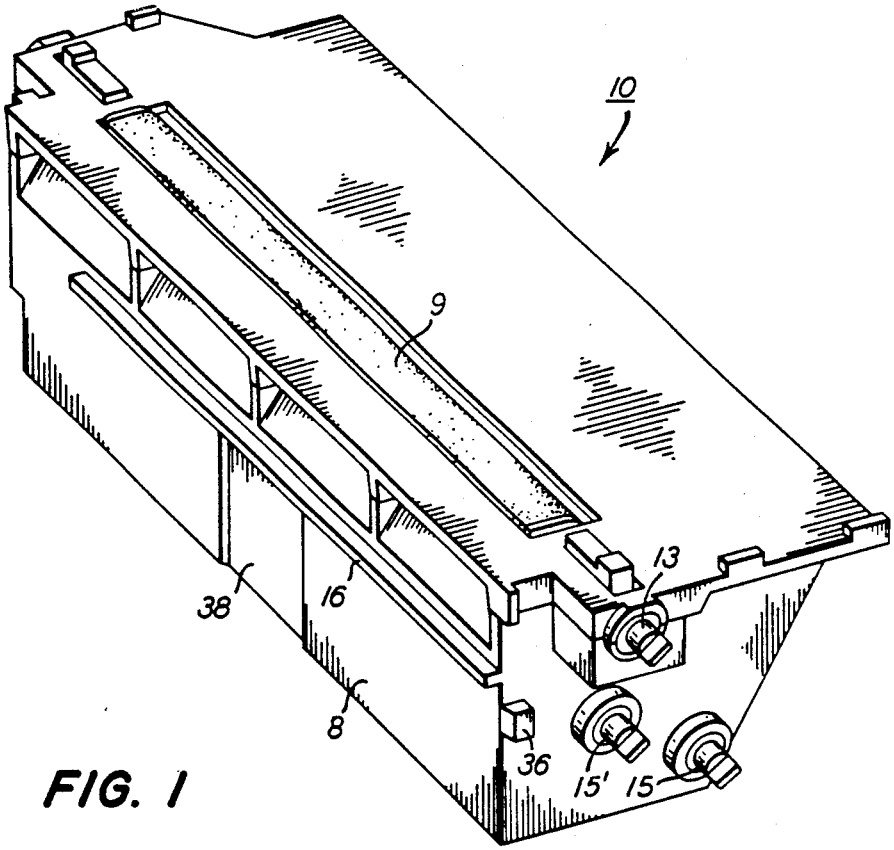
FIG. 1
FIG. 5
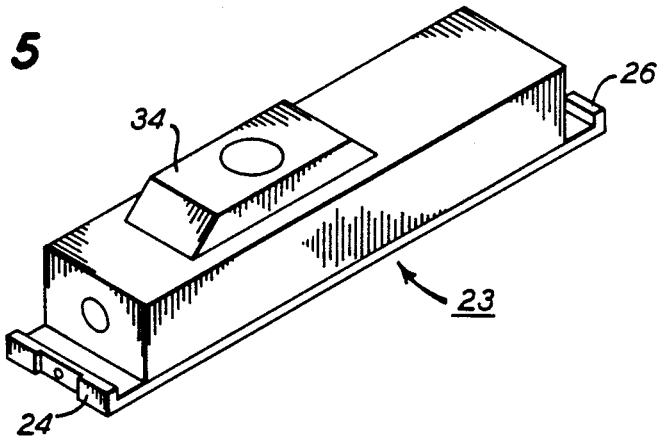

DEVELOPMENT STATION HAVING TONER MONITOR

CROSS REFERENCE TO RELATED APPLICATIONS

Reference is made to commonly assigned U.S. patent applications Ser. No. 116,200, now U.S. Pat. No. 4,797,704 filed by L. A. Hill and M. E. Jacobs, A. S. Kroll and R. E. Williams on Nov. 3, 1987 and Ser. No. 215,971 filed by K. A. Arnold, L. A. Hill, and K. S. Robinson on July 7, 1988.

TECHNICAL FIELD

This invention relates generally to replaceable development stations for use in electrostatographic machines having developer mixture concentration monitors.

BACKGROUND ART

Electrostatographic machines generally use a two-component developer mixture comprised of a toner powder and a magnetized or magnetizable carrier material. During the use of the machine, toner powder has to be replenished to compensate for its consumption during image development. Various automatic toner replenishment systems are known wherein a signal from a toner concentration monitor controls replenishment. Toner monitors may take several forms, including optical sensors, capacitance sensors, resistance sensors, inductance sensors, magnetic sensors, etc.

Commonly U.S. patent applications Ser. No. 116,200, now U.S. Pat. No. 4,797,704 filed by L. A. Hill and M. E. Jacobs on Nov. 3, 1987 and Ser. No. 215,971 filed by K. A. Arnold, L. A. Hill, and K. S. Robinson on July 7, 1988 disclose a replaceable development station for developing electrostatic images. The device is slid endwise into place in an electrostatographic machine so that the entire development station is removable when its original supply of toner is exhausted.

Generally, such development stations are disposable. Therefore it is not practical to provide a toner concentration monitor in each station. However, for toner monitors to work optimally, they must not be separated from the development mixture by thick development station walls. However, structural integrity of the development Station requires substantial wall thicknesses. By the present invention, structure has been provided to permit location of a toner concentration monitor on the electrostatographic machine so that the entire development station is replaceable without replacement of the monitor, and which overcomes the problem associated with the thickness of the station walls interfering with the sensitivity of the monitor.

DISCLOSURE OF INVENTION

In accordance with the above, the present invention provides a replaceable development station usable for developing electrostatic images in an apparatus having a toner monitor and means for slidably receiving the development station. The development station includes a chamber containing a supply of a development mixture of toner and carrier particles. A recess is defined in one wall of the chamber for receiving the toner monitor, the recess being defined by a thinned region of the wall such that the toner monitor is separated from the developer mixture by a wall region substantially thinner than the general wall thickness.

According to a preferred embodiment of the present invention, the development station is usable in an apparatus having a toner monitor movable in first and second opposed directions and means for slidably receiving the development station in third and fourth opposed directions substantially normal to the first and second directions. A recess is defined by a thinned region of a wall normal to the first and second directions when the station is slid into the receiving means such that the toner monitor is separated from the developer mixture in the development station housing by a wall region substantially thinner than the general thickness of said wall. The toner monitor is moved in one of the first and second directions as the development station is slid into the receiving means, and in the other of said first and second directions when said development station is fully inserted in the receiving means. The moving means is a cam surface on the development station.

The invention, and its objects and advantages, will become more apparent in the detailed description of the preferred embodiments presented below

BRIEF DESCRIPTION OF THE DRAWINGS

In the detailed description of the preferred embodiments of the invention presented below, reference is made to the accompanying drawings, in which FIG. 1 is a perspective view of a replaceable development station constructed according to the present invention;

FIG. 5 is a perspective view of a toner monitor;

BEST MODE FOR CARRYING OUT THE INVENTION

Figure 2:
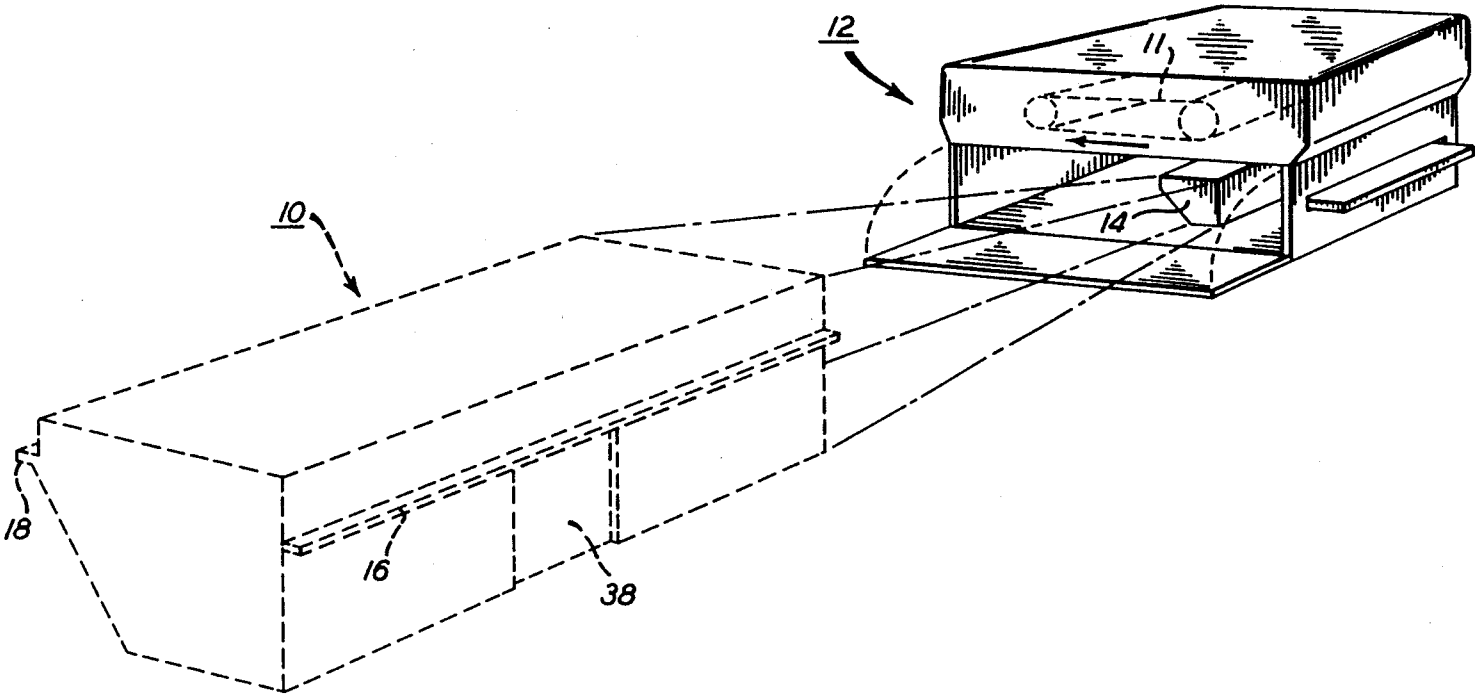
FIG. 2 is a perspective view of the development station of FIG. 1, and further showing an electrostatographic machine usable therewith.

Referring to FIG. 1 of the drawings, a replaceable development station according to a preferred embodiment of the present invention is generally designated 10 with wall means defining a chamber containing a supply of a development mixture of toner and carrier particles. The development station has a disposable plastic housing 8, an applicator 9, an a drive coupling 13, and two other couplings 15' an 15. Further details of the replaceable development station can be found in commonly assigned, co-pending U.S. patent application Ser. No. 116,200, now U.S. Pat. No. 4,797,704 filed Nov. 3, 1987. The disclosure of that application is specifically incorporated by reference herein. As shown in FIG. 2, development station 10 can be used to develop latent electrostatic images on a photoconductor 11 of an electrostatographic machine such as a copier or printer 12 as the photoconductor is driven past the development station in the direction indicated by the arrow.

Figure 3:
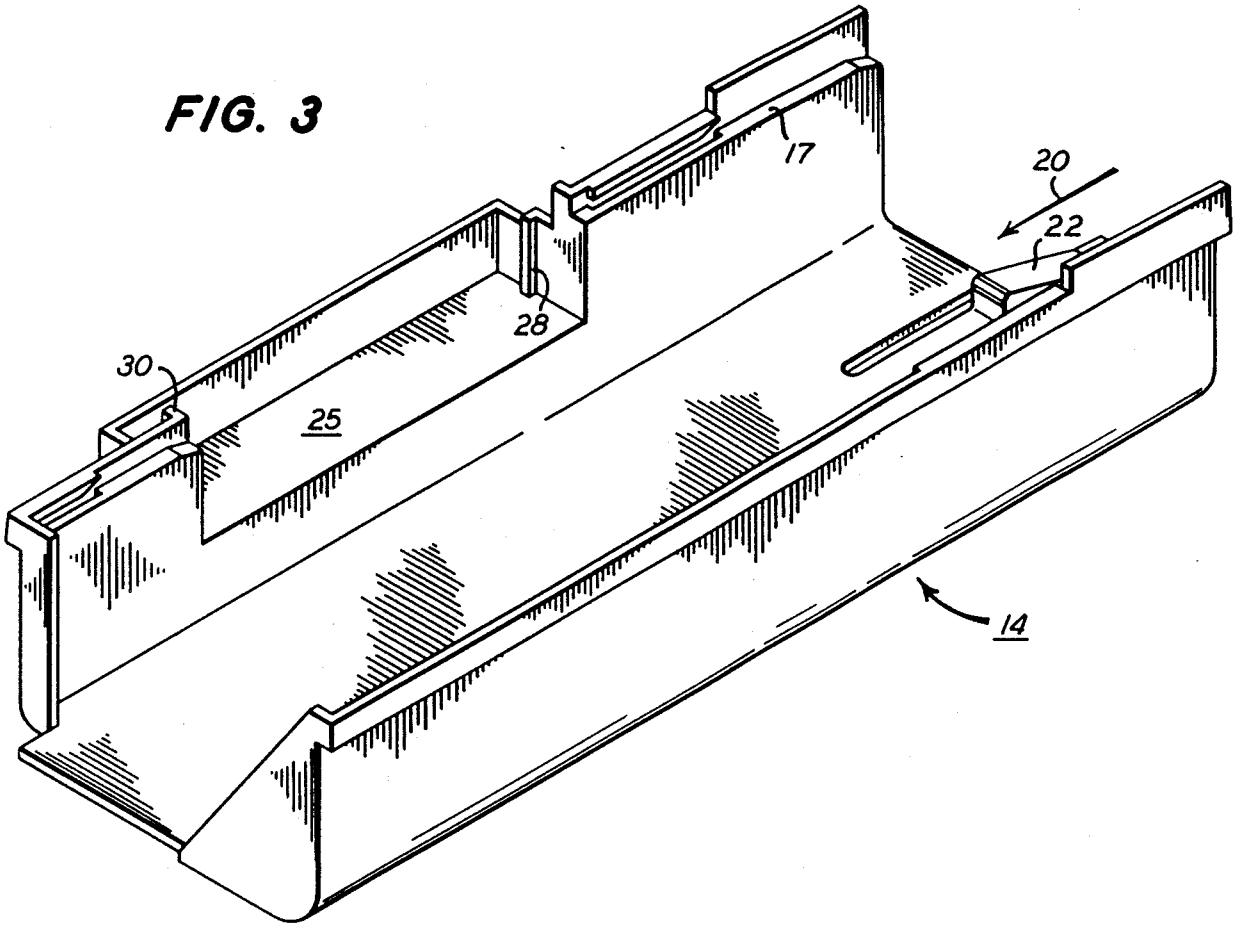
FIG. 3 is a perspective view of a channel portion of the electrostatographic machine of FIG. 2 adapted to receive the development station of FIG. 1.

Development station 10 preferably has suitable guides 16 and 18 for facilitating location of the station in a receiving channel 14 of copier or printer 12. The receiving channel is shown in greater detail in FIGS. 2 and 3. Development station guides 16 and 18 slide respectively on surfaces 17 and 19 of the receiving channel as the station is inserted into the channel in the direction of arrow 20. A spring-biased tab 22 releasably latches the development station in the receiving channel.

Figure 4:
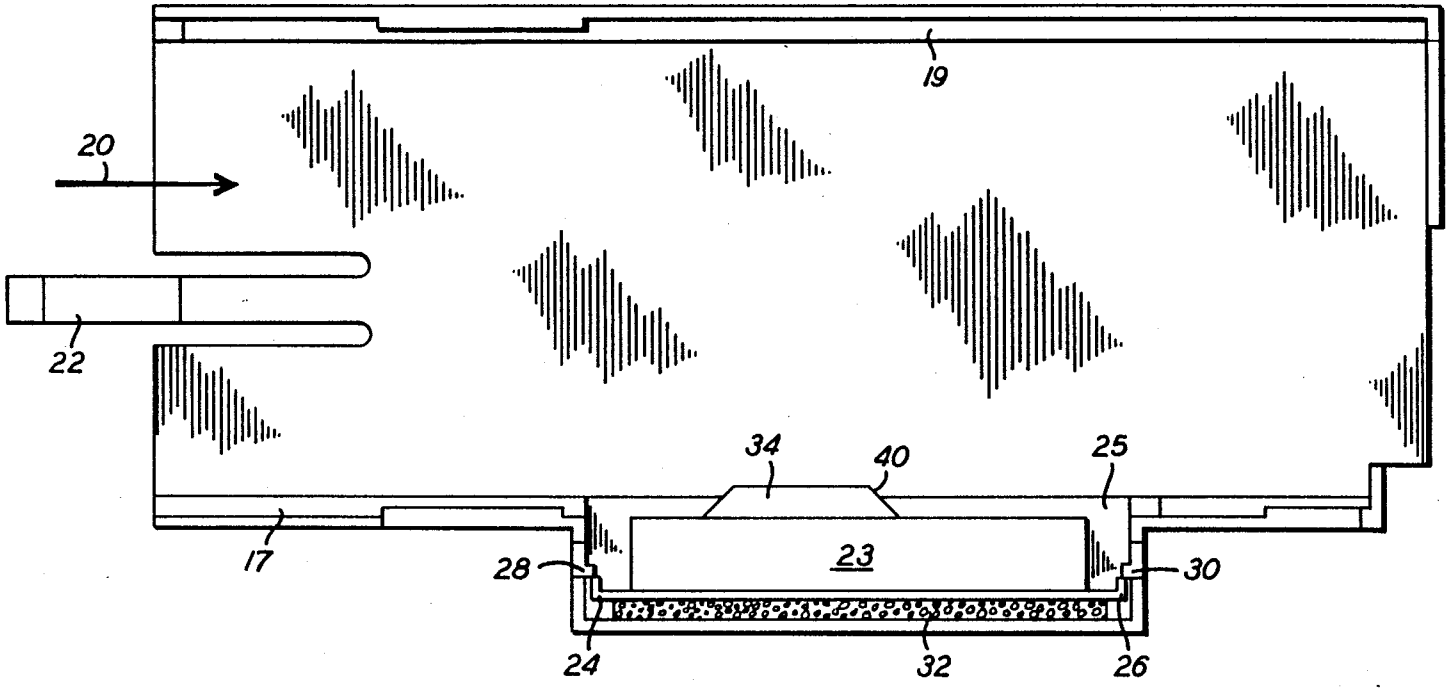
FIG. 4 is a top plan view of the receiving channel of FIG. 3, together with a toner monitor.

A toner monitor 23, best seen in FIGS. 4 and 5, is provided in receiving channel 14 for measuring the toner concentration of the developer mixture in development station 10. Toner monitors are well known, and may be of several types, such as, for example, those described in the Background Art section hereof.

As seen in FIG. 4, toner monitor 23 is carried in a cavity 25 in receiving channel 14. A pair of locating tabs 24 and 26 are positioned behind respective rails 28 and 30, and the monitor is resiliently urged forwardly in the cavity by a foam pad 32. When unimpeded, a portion 34 of the monitor extends into the region which receives development station 10.

Figure 6:
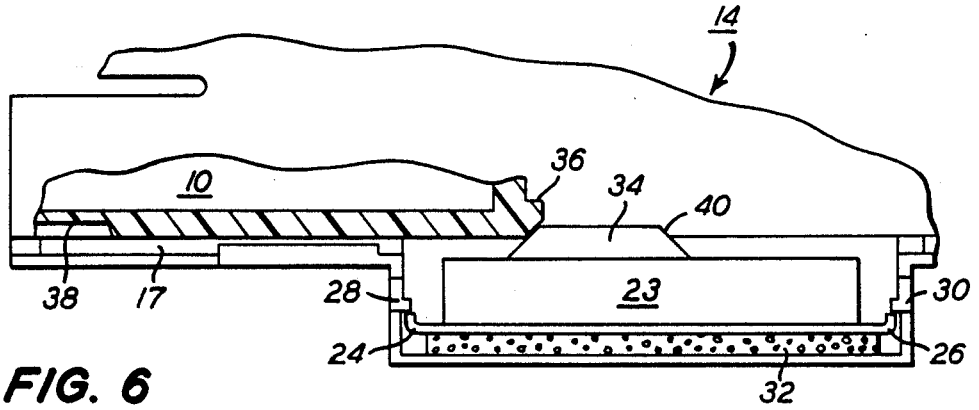
FIGS. 6–8 top views of portions of the development station of FIG. 1 and the receiving channel of FIG. 3 in progressive stages of loading.
Figure 7:
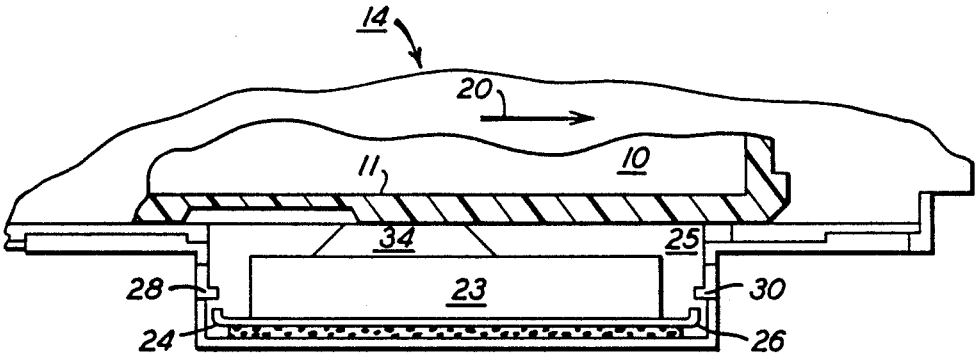
Figure 8:
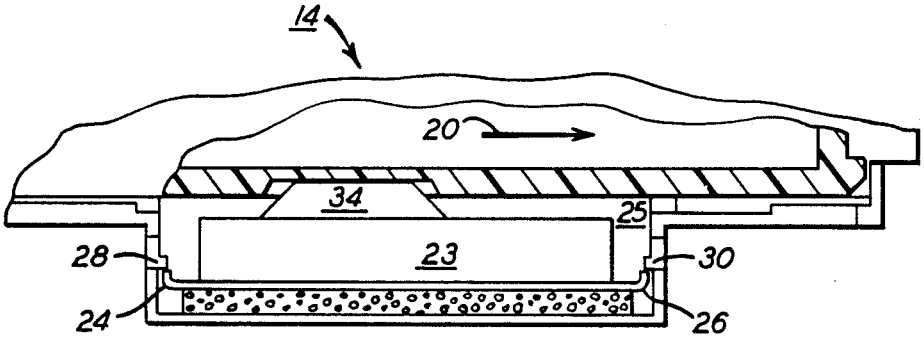

FIGS. 6–8 show the relative positions of receiving channel 14, development station 10, and toner monitor 23 as the development station is slid into the receiving channel. As shown i FIG. 6, a cam member 36 on the development station 10 first engages portion 34 of toner monitor 23 and pushes the toner monitor rearwardly in cavity 25 against the resilient force of foam pad 32; making way for further insertion of the development station into the receiving channel as shown in FIG. 7.

Referring to FIG. 8, as the development station approaches its fully-inserted position, portion 34 of the toner monitor aligns with a recess 38 in plastic housing 11 of the development station, and the toner monitor moves forwardly of cavity 25 and extends into recess 38.

Recess 38 is defined by a thinned region of the wall of the development station, and is provided so that the toner monitor is separated from the development mixture by as thin a development station wall as possible, while still maintaining structural integrity of the development station.

When the development station is withdrawn from the receiving channel, an inclined wall on the trailing edge of recess 38 engages an inclined wall 40 on toner monitor portion 34 and cams the toner monitor back into cavity 25 to make room for the development station to pass.

The invention has been described in detail with particular reference to preferred embodiments thereof, but it will be understood that variations and modifications can be effected within the spirit and scope of the invention.

What is claimed is:

1. A replaceable development station usable for developing electrostatic images in an apparatus having a toner concentration monitor movable in first and second opposed directions and means for slidably receiving said development station in third and fourth opposed directions substantially normal to the first and second directions; said development station comprising:

a housing containing a development mixture of toner and carrier particles and including a wall normal to the first and second directions when the station is slid into the receiving means; and a recess defined in said wall for receiving the toner concentration monitor, a recess being defined by a thinned region of the wall such that the toner concentration monitor is separated from the developer mixture in the development station housing by a wall region substantially thinner than the general thickness of said wall.

2. A replaceable development station as defined in claim 1 further comprising means for moving the toner concentration monitor in one of said first and second directions as said development station is slid into the receiving means, and in the other of said first and second directions when said development station is fully inserted in the receiving means.

3. A replaceable development station as defined in claim 2 wherein said moving means is a cam surface on said development station.

4. A replaceable development station usable for developing electrostatic images in an apparatus having a toner concentration monitor movable in first and second opposed directions and means for slidably receiving the development station in third and fourth opposed directions substantially normal to the first and second directions; said development station comprising:

a recess defined by a thinned region of a wall normal to the first and second directions when the station is slid into the receiving means such that the toner concentration monitor is aligned with the thinned region and extends into the recess so as to be separated from the developer mixture in the development station housing by a wall region substantially thinner than the general thickness of said wall.

* * * * *